US008286709B2

(12) United States Patent
Mennem et al.

(10) Patent No.: US 8,286,709 B2
(45) Date of Patent: Oct. 16, 2012

(54) MULTI-POINT CHEMICAL INJECTION SYSTEM

(75) Inventors: Rex C. Mennem, Stafford, TX (US); Dinesh R. Patel, Sugar Land, TX (US); David Himmel, Pearland, TX (US); Angel R. Reyes, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 343 days.

(21) Appl. No.: 12/576,417

(22) Filed: Oct. 9, 2009

(65) Prior Publication Data

US 2010/0101788 A1 Apr. 29, 2010

Related U.S. Application Data

(60) Provisional application No. 61/109,326, filed on Oct. 29, 2008.

(51) Int. Cl.
*E21B 34/00* (2006.01)

(52) U.S. Cl. ..... 166/316; 166/334.4; 166/305.1

(58) Field of Classification Search ..... None
See application file for complete search history.

(56) References Cited

U.S. PATENT DOCUMENTS

| | | | | |
|---|---|---|---|---|
| 4,565,215 | A | 1/1986 | Cummings | |
| 6,491,102 | B2 | 12/2002 | Leismer et al. | |
| 6,684,950 | B2 | 2/2004 | Patel | |
| 7,048,048 | B2 | 5/2006 | Nguyen et al. | |
| 7,049,272 | B2 | 5/2006 | Sinclair et al. | |
| 7,066,284 | B2 | 6/2006 | Wylie et al. | |
| 7,234,524 | B2 | 6/2007 | Shaw et al. | |
| 7,341,117 | B2 | 3/2008 | Wylie et al. | |
| 2006/0124318 | A1 * | 6/2006 | Sheffield | 166/381 |
| 2006/0144590 | A1 | 7/2006 | Cardenas et al. | |
| 2006/0278399 | A1 * | 12/2006 | Dwivedi et al. | 166/375 |
| 2009/0188666 | A1 | 7/2009 | Habib et al. | |

* cited by examiner

*Primary Examiner* — Angela M DiTrani
(74) *Attorney, Agent, or Firm* — Rodney Warfford; Tim Curington; Robert Van Someren

(57) ABSTRACT

A technique enables injection of treatment chemicals at a plurality of desired locations along a well. A multi-point chemical injection system is connected and deployed into a wellbore. The multi-point chemical injection system delivers one or more treatment chemicals along the wellbore to the desired locations at a plurality of injection zones. A single control line is run from a surface location down through the wellbore to the plurality of injection zones. The single control line is used to deliver the treatment chemical to each of the injection zones.

26 Claims, 7 Drawing Sheets

MULTI-POINT CHEMICAL INJECTION SYSTEM

CROSS-REFERENCE TO RELATED APPLICATION

The present document is based on and claims priority to U.S. Provisional Application Ser. No. 61/109,326, filed Oct. 29, 2008.

BACKGROUND

In many types of wells, various treatment applications are utilized to ultimately improve well production. Treatment applications often comprise the injection of fluids at desired locations along the wellbore. For example, chemicals may be injected into the surrounding reservoir in one or more well zones. Generally, a treatment string is delivered downhole into a wellbore to enable the delivery of treatment fluids to the desired location or locations.

Treatment of more than one well zone can be problematic because of the need to deliver treatment fluid to more than one location. In some applications, the treatment string can be released and moved to subsequent well zones, however the setting and releasing of the treatment string is difficult in many environments. In other applications, several separate control lines are run from the surface such that each control line is routed to a unique injection location. However, the use of multiple control lines requires multiple bypass ports through various system components, such as the wellhead and the production packer. In other applications, generally a single control line is run from the surface for injecting chemical in the production tubing from a single point or location. However, chemical injection at a multiple points in multiple reservoirs from a single control line run from surface may result in an unequal fluid volume injection in each zone. Zones with the lowest reservoir pressure will take greatest volume of fluid and zones with highest pressure will take smallest fluid volume. A depleted zone may take all the fluid. This may defeat the purpose of injecting chemicals in the production steam. Therefore, it may be desirable to have a chemical injection system that will allow deliver chemicals at a multiple points in a multiple zones in uniform volume or according to other desired proportions from a single control line run from surface.

SUMMARY

In general, the present disclosure provides a technique for injecting chemicals in a well. A multi-point chemical injection system is connected and deployed along a wellbore. The multi-point chemical injection system is designed to deliver a treatment chemical along the wellbore to a plurality of injection zones, including injection into the tubing as well as the annulus. A single control line is run from a surface location down through the wellbore to the plurality of zones, and the single control line is used to deliver the treatment chemical to each of the zones.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
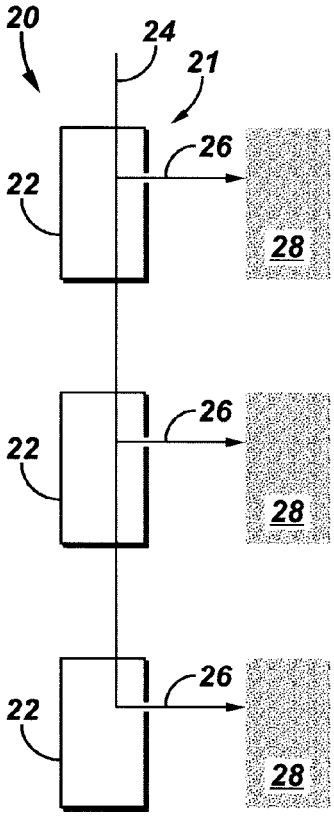
FIG. 1 is a schematic illustration of one example of an injection system for use in a well, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present disclosure generally involves a system and methodology related to well treatment operations involving the injection of chemicals at a plurality of unique well locations. The system and methodology greatly simplify and improve the efficiency of the treatment application. In general, the technique utilizes a multi-point (e.g., at least two) injection system that delivers treating chemicals to a plurality of well zones, such as production zones. The system can be used to deliver treating chemicals to the well zones uniformly or according to other desired proportions via a single control line run from the surface.

According to one embodiment, the multi-point injection system comprises a plurality of chemical injection valve systems deployed at desired locations along a wellbore. The chemical injection valve systems are joined by the single control line run from the surface, and a portion of the treating chemical is metered out at each chemical injection valve system. For example, a portion of the treating chemical is metered out at a first injection valve system and the remainder of the treating chemical is bypassed to a next sequential injection valve system. This process may be repeated for each subsequent zone until the treating chemical is introduced into the desired number of well zones along the wellbore.

By way of example, each chemical injection valve system may comprise a valve mandrel having a housing containing a fluid metering valve positioned in a flow-through passage, as described in greater detail below. One or more check valves may be positioned in the flow-through passage to enable passage of treatment chemical while preventing backflow of reservoir fluids into the single control line. The fluid metering valves used in the chemical injection valve systems may be designed to deliver uniform amounts (or other desired amounts) of treating chemicals to each of the production zones or other well zones or at a multiple points in a single production zone.

Additionally, the fluid metering valves may be used in cooperation to compensate for differences in reservoir pressures at the various well zones and for any pressure losses associated with restrictions and/or friction between the treating chemical and the control line to ensure that a desired, e.g. uniform, amount of chemical is delivered to each well zone. For example, if the reservoir pressure at a second well zone is higher than at a first well zone, the fluid metering valve in the first well zone creates a flow restriction that compensates for the higher pressure in the lower, second well zone. This compensation allows uniform amounts of treating chemicals to be delivered to each well zone. The compensation process is an autonomous process capable of constantly adjusting to reservoir properties to ensure uniform delivery of treating chemicals. In one embodiment, the fluid metering valves comprise variable position chokes designed to compensate for differences in reservoir pressures.

Referring generally to FIG. 1, one example of a well system 20 that can be used to inject treatment chemicals at desired locations in a well is illustrated schematically. In this example, well system 20 comprises a multi-point chemical injection system 21 having at least two chemical injection valve systems 22 positioned at desired and unique valve system locations in the well. For purposes of explanation, well system 20 is illustrated with three unique chemical injection valve systems 22; however other numbers of chemical injection valve systems may be used depending on the number of well zones to be treated. A treating chemical is introduced into system 20 and delivered to the plurality of chemical injection valve systems 22 via a single injection/control line 24. At each valve system 22, a portion of the treating chemical, as represented by arrow 26, is injected into a surrounding well zone 28, such as a production zone. The remaining portion of treating chemical is bypassed to the next sequential chemical injection valve system until the lowermost chemical injection valve system is reached.

It should be noted that system 20 may be used in horizontal wells, in which case lowermost refers to the chemical injection valve system located furthest downstream, often towards the toe of the horizontal wellbore. In this latter example, the upper chemical injection valve systems are those located upstream from the lowermost system and further away from the toe of the wellbore. Regardless, the single control line 24, in cooperation with the valve systems 22, provides a simplified system and methodology for directing controlled flows of treatment chemical to a plurality of well zones. The design further enables the simultaneous injection of treatment chemical into the plurality of well zones that are to be treated.

Figure 2:
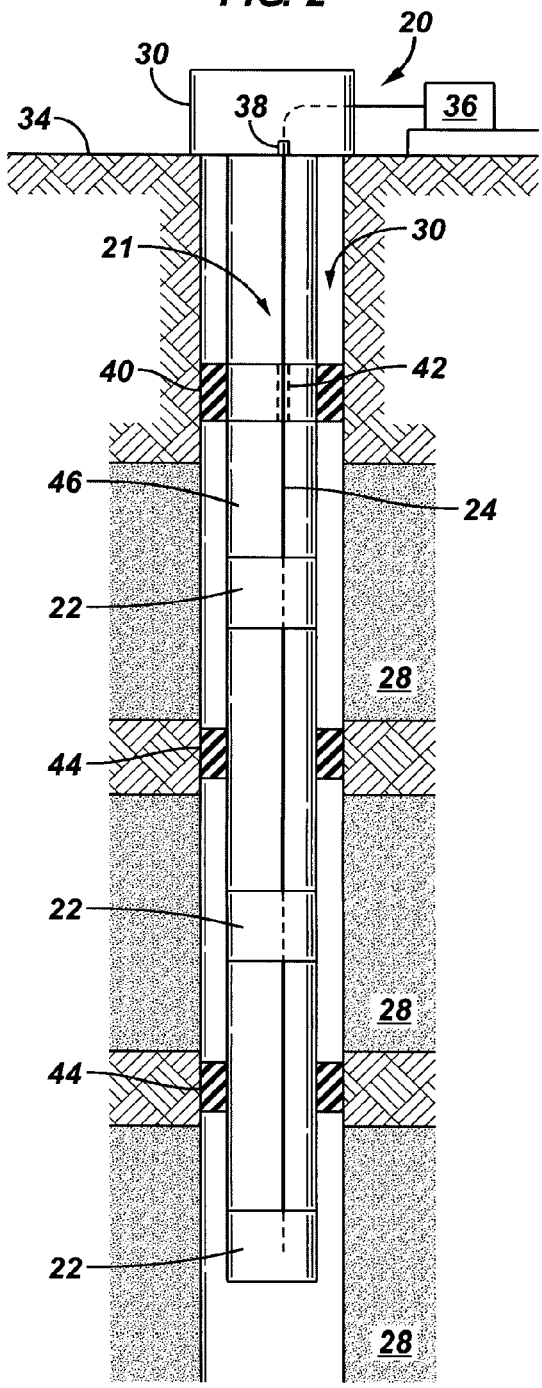
FIG. 2 is a front elevation view of one example of an injection system positioned in a wellbore, according to an embodiment of the present invention.

In FIG. 2, a more detailed example of well system 20 is illustrated according to one embodiment of the present invention. In this example, multi-point injection system 21 is deployed in a wellbore 30 that has been drilled down into a subterranean formation having multiple well zones 28. The well treatment system 20 may further comprise a wellhead 32 positioned above wellbore 30 at a surface location 34.

In the illustrated example, well system 20 comprises a treatment chemical delivering system 36, e.g. a pumping system, designed to deliver treating chemical fluid downhole through the single control line 24. As illustrated, the single control line 24 may be routed through wellhead 32 via a single bypass port 38. Similarly, the single control line 24 can be routed through an upper packer 40, such as a production packer, via a single packer bypass port 42. Other isolation devices 44, e.g. packers, can be used to isolate regions of wellbore 30, such as regions associated with each well zone 28. In some applications, the single control line 24 also is routed through these isolation devices 44 via single bypass ports.

Chemical injection valve systems 22 are connected into a well string 46 and deployed along the wellbore 30 at desired valve system locations. In some applications, well string 46 comprises a tubing string that can be used to deliver production fluids, e.g. hydrocarbon based fluids, uphole to surface location 34 from each of the well zones 28. The chemical injection valve systems 22 may be connected by sections of tubing, production components, and other downhole equipment that properly space the injection valve systems for delivery of the treating chemical to the desired well zones. It should be noted that a variety of completion components and other downhole equipment can be incorporated into well string 46 and the overall well system 20.

Figure 3:
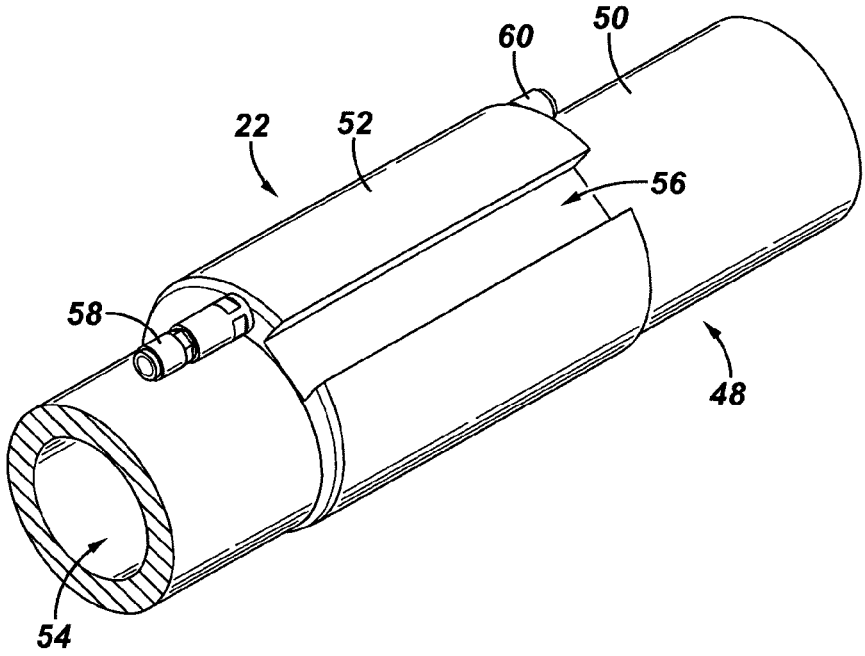
FIG. 3 is an orthogonal view of one example of a chemical injection valve system that may be utilized in the injection system to deliver a treatment chemical to an injection zone, according to an embodiment of the present invention.

Referring generally to FIG. 3, one embodiment of a chemical injection valve system 22 is illustrated. In this example, the valve system 22 is an upper valve system of a type that can be used upstream of the lowermost valve system. As illustrated, the chemical injection valve system 22 comprises a valve mandrel 48 having a mandrel housing 50 with a radially extended portion 52. As further illustrated in FIG. 4, mandrel housing 50 comprises a primary passage 54 that may be coupled with the tubing sections, production components and/or other downhole equipment of well string 46. In some applications, the primary passage 54 is used to direct a flow of produced fluids uphole to a surface location. In the example illustrated, the radially extended portion 52 of mandrel housing 50 is designed to accommodate the flow of treatment chemicals directed downhole through single control line 24. As illustrated, the radially extended portion 52 also comprises a longitudinal recess 56 that may be used to accommodate other types of equipment positioned or routed downhole along well string 46.

Figure 4:
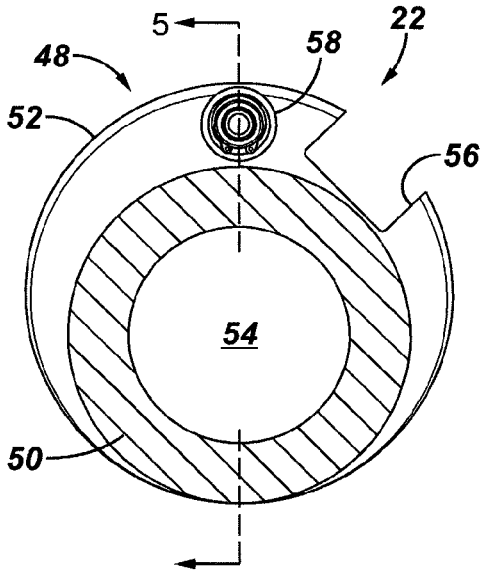
FIG. 4 is an end in view of the chemical injection valve system illustrated in FIG. 3, according to an embodiment of the present invention.

As further illustrated in FIGS. 3 and 4, the single control line 24 may be coupled to an upstream side of the chemical injection valve system 22 via a connector 58. Connector 58 extends from an upstream longitudinal end of radially extended portion 52 to enable easy coupling of the valve system 22 with the single control line 24. Similarly, a second connector 60 is disposed on a downstream side of radially extended portion 52 to enable coupling of the single control line 24 between the illustrated chemical injection valve system 22 and the next sequential valve system located downstream. By way of example, connectors 58, 60 may comprise hydraulic dry mate connectors of the type used for making control line connections.

Figure 5:
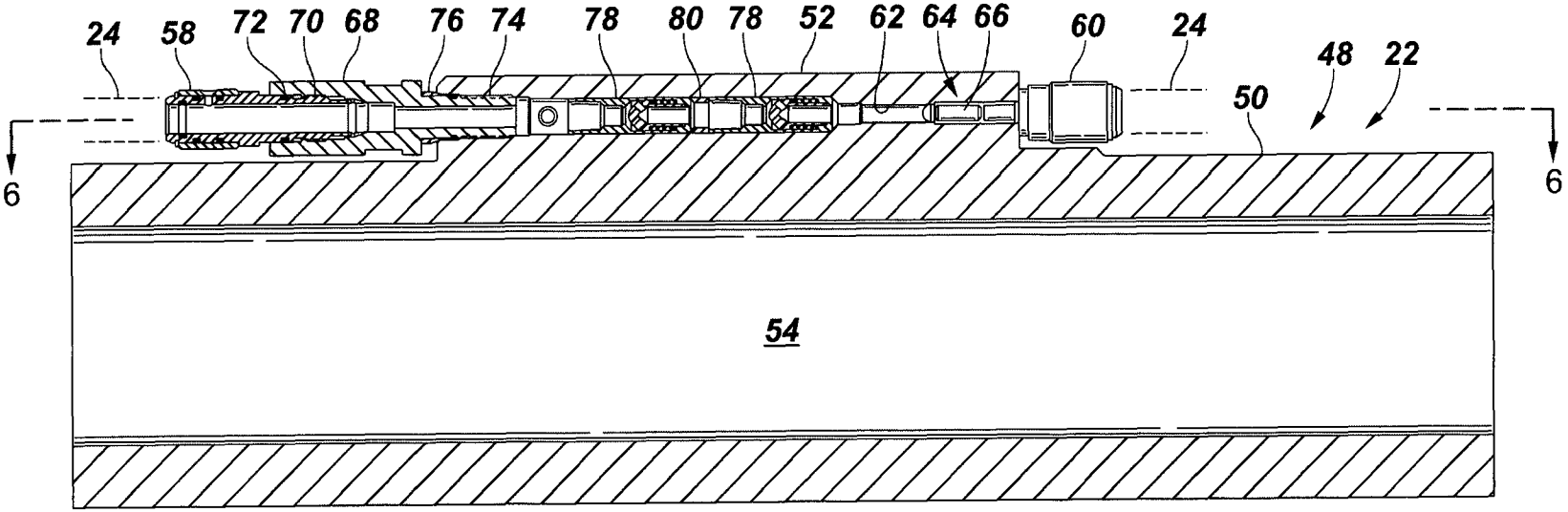
FIG. 5 is a cross-sectional view taken generally along line 5-5 in FIG. 4, according to an embodiment of the present invention.

A portion of the treatment chemical is injected into the well zone 28, e.g. into the wellbore and/or reservoir, surrounding the chemical injection valve system 22, and the remaining portion is bypassed to the next sequential chemical injection valve system. One embodiment of components that can be used to provide the injection and bypass functions is illustrated in FIG. 5. In the embodiment illustrated, a flow-through passage 62 extends through mandrel housing 50, and specifically through radially extended portion 52, to enable injection of treatment chemical into the region surrounding the chemical injection valve system 22. Single control line 24 is connected to flow-through passage 62 via the upstream connector 58 and delivers a treating chemical which flows through passage 62 and is dispersed to the surrounding well zone 28 through a fluid metering valve 64, such as a FLOSERT fluid metering valve.

The fluid metering valve 64 controls the amount of fluid injected into the surrounding region. In one example, the fluid metering valve 64 comprises a variable position choke 66 that effectively restricts or chokes the amount of treatment chemical that can move along flow-through passage 62 to the surrounding region. As described in greater detail below, the remaining portion of the treating chemical bypasses flow-through passage 62 and is directed to the next sequential chemical injection valve system 22.

In the example illustrated in FIG. 5, connector 58 is mounted to radially extended portion 52 of mandrel housing 50 via an adapter plug 68. Connector 58 may be threadably engaged with adapter plug 68 via a threaded region 70 and sealed with respect to the adapter plug 68 via one or more seals 72. Similarly, adapter plug 68 may be threadably engaged with radially extended portion 52 within flow-through passage 62 via a threaded region 74. The adapter plug 68 is sealed with respect to the mandrel housing 50 by one or more suitable seals 76, such as a seal ring. It should be noted, however, a variety of other connection mechanisms and sealing mechanisms may be utilized other than the illustrated threaded engagements and seal rings.

Figure 6:
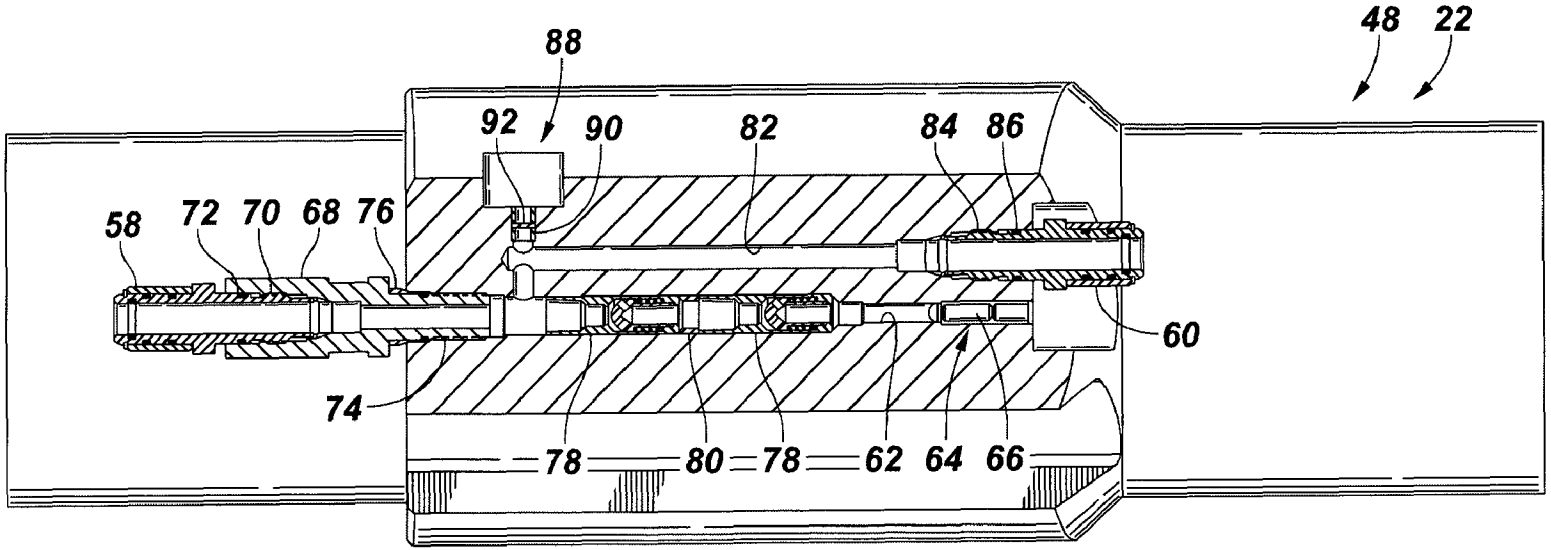
FIG. 6 is a cross-sectional view taken generally along line 6-6 in FIG. 5, according to an embodiment of the present invention.

Within flow-through passage 62, one or more check valves may be used to enable downstream flow of treatment chemical while preventing backflow of reservoir fluid from the surrounding environment. In the example illustrated, the chemical injection valve system 22 comprises a pair of check valves 78 mounted on opposite sides of a dual insert adapter 80. As further illustrated best in FIG. 6, the flow-through passage 62 also is in fluid communication with a bypass passage 82. In this example, bypass passage 82 is coupled with flow-through passage 62 at a position between adapter plug 68 and check valves 78. Fluid metering valve 64 restricts the amount of treatment chemical injected into the surrounding well zone 28 and thus causes the remaining portion of treatment fluid to move into bypass passage 82 and to exit the chemical injection valve system 22 via connector 60.

Similar to connector 58, connector 60 may be coupled to the mandrel housing 50 on a downstream side of radially extended portion 52. The connector 60 may be coupled with radially extended portion 52 via a suitable connection mechanism, such as a threaded engagement region 84 at which the connector 60 is threadably engaged along an interior of bypass passage 82. The connector 60 may be sealed with respect to radially extended portion 52 via one or more suitable seals 86. A segment of the single control line 24 is used to couple connector 60 with the upstream connector 58 of the next sequential chemical injection valve system 22.

Depending on the specific downhole injection application, the bypass passage 82 also may be connected with an emergency release system 88 to enable release of the treatment chemical to the surrounding well zone in the event flow of fluid through the chemical injection valve system is blocked. In this example, system 88 comprises a release passage 90 in which is mounted a fracture member 92, e.g. a rupture disc, or other suitable pressure release mechanism.

In operation, a treatment chemical fluid enters the chemical injection valve system 22 through single control line 24 and then passes through check valves 78. The fluid metering valve 64 chokes the flow of treatment chemical fluid so that only a portion of the fluid is directed to the surrounding well zone 28. The remaining portion of the treatment chemical fluid travels around check valves 78 and fluid metering valve 64 via bypass passage 82. The bypass passage 82 is coupled with the next sequential chemical injection valve system 22 via a segment of the single control line 24. The next sequential chemical injection valve system 22 performs the same function of injecting a portion of the chemical treatment fluid and bypassing the remaining portion. This process is repeated down to the lowermost chemical injection valve system 22 which does not require a bypass passage. Thus, the chemical injection valve systems 22 allow simultaneous injection of the treatment chemical into a plurality of well zones with the single hydraulic line 24.

The fluid metering valves 64 of the plurality of chemical injection valve systems 22 may be selected to deliver a desired amount of chemical treatment fluid at each well zone. Additionally, the fluid metering valves 64 provide desired restrictions to flow in a manner that allows the valves 64 to be used in cooperation to compensate for differences in reservoir pressures at the various well zones 28. The fluid metering valves 64 also may be designed to compensate for any pressure losses associated with restrictions and/or friction between the treatment chemical fluid and the control line to ensure that a uniform amount (or other desired amount) of chemical treatment fluid is delivered to each zone.

Figure 7:
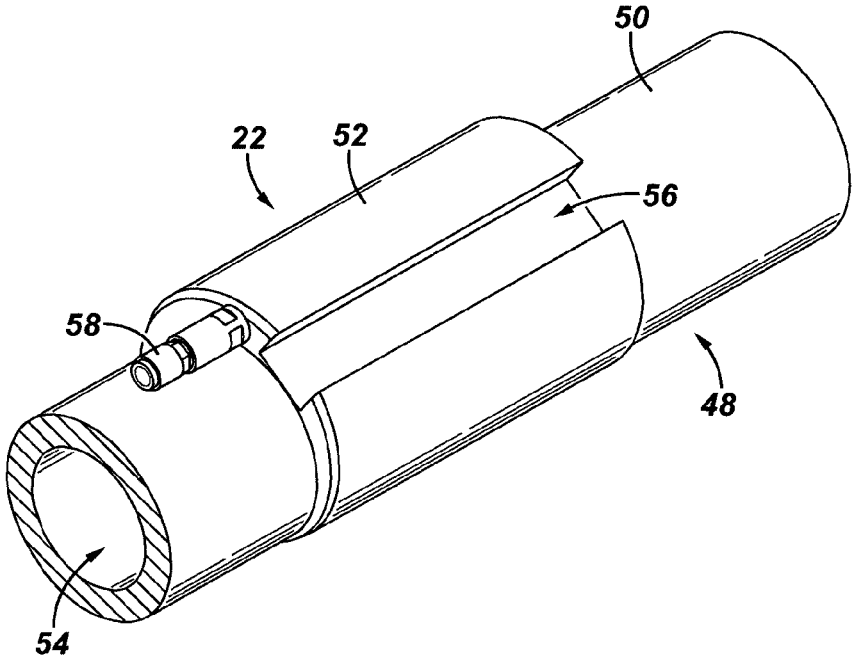
FIG. 7 is an orthogonal view of one example of a lower chemical injection valve system that may be utilized at the lower end of the injection system to deliver a treatment chemical to the lowermost injection zone, according to an embodiment of the present invention.

Referring generally to FIG. 7, one example of a chemical injection valve system 22 that can be used in the lowermost/downstream injection position is illustrated. In this embodiment, the chemical injection valve system 22 comprises connector 58 positioned on the treatment chemical inlet side, but connector 60 is unnecessary because there is no need to bypass a portion of the treatment chemical fluid.

Figure 8:
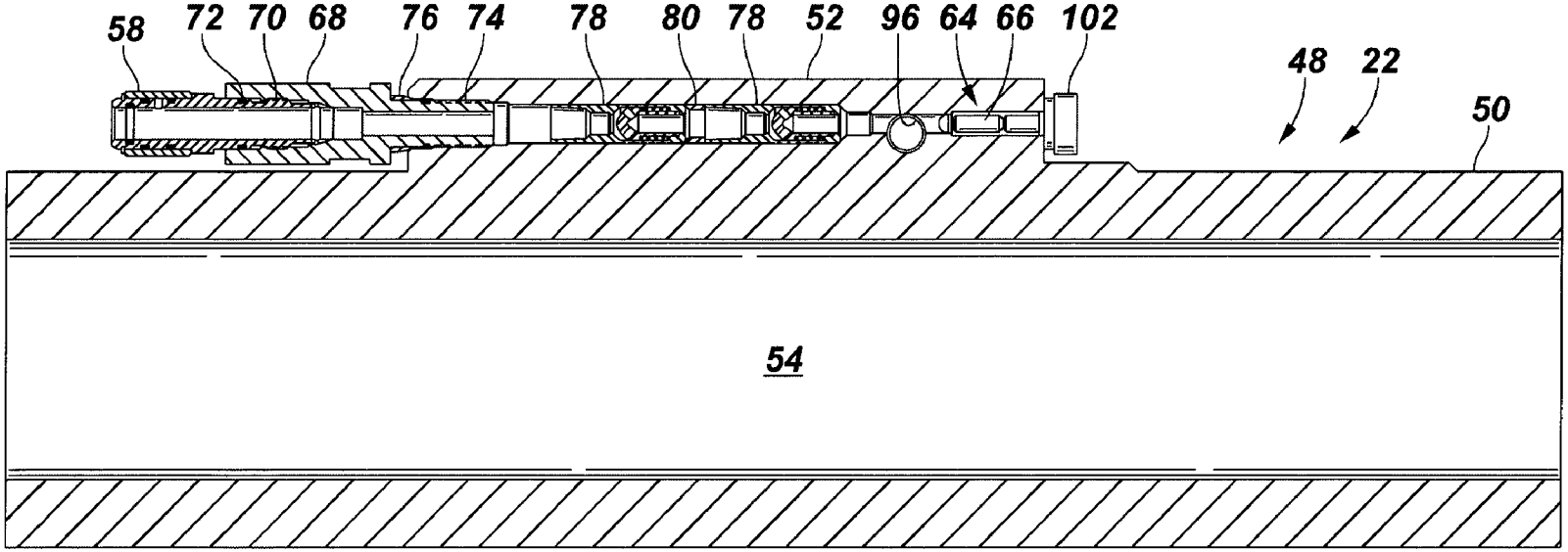
FIG. 8 is a cross-sectional views similar to that of FIG. 5 but showing the lower chemical injection valve system, according to an embodiment of the present invention.
Figure 9:
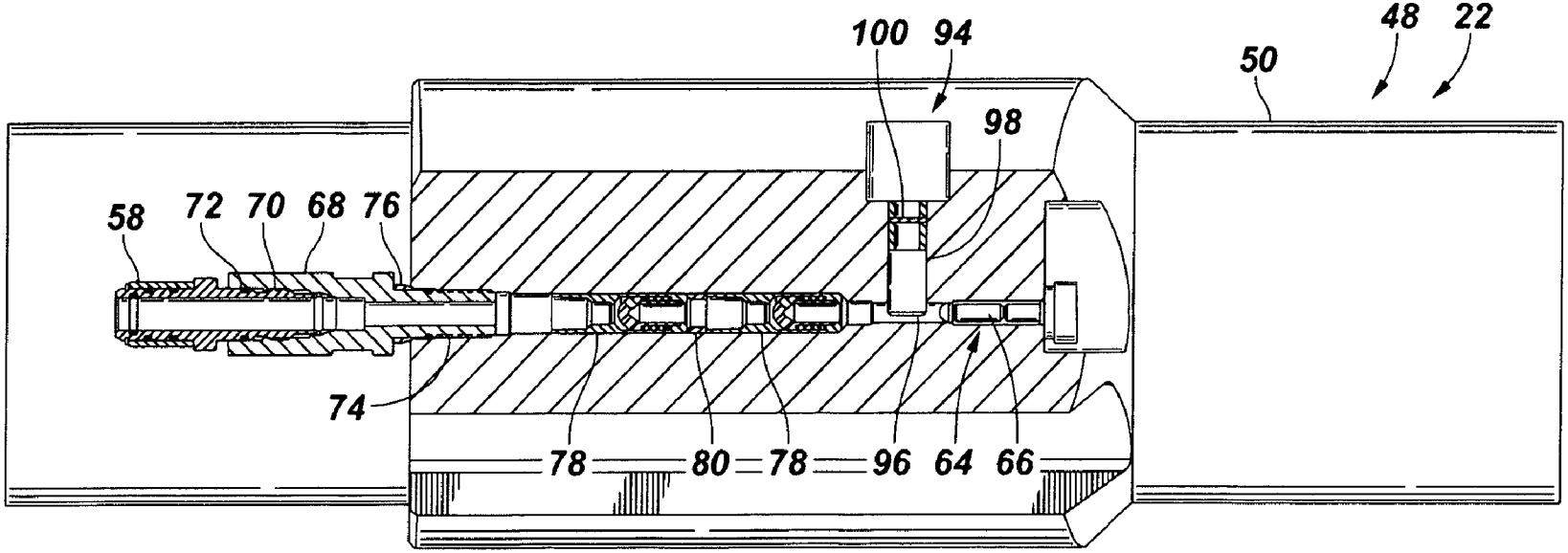
FIG. 9 is a cross-sectional views similar to that of FIG. 6 but showing the lower chemical injection valve system, according to an embodiment of the present invention.

By way of example, the lowermost chemical injection valve system 22 may comprise flow-through passage 62 with fluid metering valve 64, check valves 78, and connector 58 mounted to radially extended portion 52 via adapter plug 68, as illustrated in FIG. 8. However, the bypass passage 82 is excluded, as illustrated best in FIG. 9. Additionally, an emergency release system 94 may be connected to flow-through passage 62 via an outlet port 96. In the example illustrated, outlet port 96 is disposed between fluid metering valve 64 and check valves 78 to enable release of the treatment chemical to the surrounding well zone in the event flow of fluid through the lowermost chemical injection valve system is blocked.

By way of example, release system 94 may comprise a release passage 98 in communication with outlet port 96. A fracture member 100, e.g. a rupture disc, or other suitable pressure release mechanism may be mounted along passage 98 to enable the pressurized release of treatment chemical fluid, if necessary. For example, the fracture member 100 may be used as a contingency for delivering treatment chemicals to the lowest well zone 28 in the event the fluid metering valves 64 become clogged with debris. In such event, the pressure in single control line 24 can be increased to break the fracture member 100 and to enable injection of the treatment chemical into the surrounding well zone 28.

The overall well system 20 may be designed to accommodate a variety of injection applications in a variety of well environments. Accordingly, the number, type and configuration of components and systems within the overall system can be adjusted to accommodate different applications. For example, the size and configuration of the valve mandrel and its housing 50 can vary. Additionally, the flow-through passage may be routed through the mandrel housing at a variety of different locations. The type of fluid metering valve and check valves employed within the flow-through passage also may be changed. Furthermore, the type of single control line 24 may vary, and the technique for coupling the single control line 24 to each chemical injection valve system can rely on a variety of connector types. Similarly, the types and arrangements of other downhole equipment used in the well string 46 are selected according to the specific well related application in which the chemical injection capabilities are to be utilized.

Although only a few embodiments of the present invention have been described in detail above, those of ordinary skill in the art will readily appreciate that many modifications are possible without materially departing from the teachings of this invention. By way of example only, although injection into the annulus is described herein, it is contemplated that the injection zone could also be a zone within the tubing. Accordingly, such modifications are intended to be included within the scope of this invention as defined in the claims.

What is claimed is:

1. A method of injecting chemicals in a well, comprising:

deploying a plurality of chemical injection valve systems at unique valve system locations in a well;

delivering a treatment chemical through a single control line to the plurality of chemical injection valve systems via the same single control line run from a surface location and coupled between the plurality of chemical injection valve systems; and metering the flow of treatment chemical into the well at each chemical injection valve system of the plurality of chemical injection valve systems to ensure a desired amount of treatment chemical is delivered into the well at each chemical injection valve system location.

2. The method as recited in claim 1, wherein deploying comprises deploying each chemical injection valve system in a separate injection zone of the well.

3. The method as recited in claim 1, wherein deploying comprises deploying the chemical injection valve system in the same production zone at multiple locations or points.

4. The method as recited in claim 1, wherein metering comprises metering the treatment chemical with a fluid metering valve positioned in a flow-through passage in each chemical injection valve system.

5. The method as recited in claim 4, wherein deploying comprises deploying a lowermost chemical injection valve system and a plurality of upper chemical injection valve systems above the lowermost chemical injection valve system.

6. The method as recited in claim 5, wherein metering comprises routing a portion of the treatment chemical past each fluid metering valve of the upper chemical injection valve systems to a next sequential chemical injection valve system.

7. The method as recited in claim 6, wherein routing comprises routing the portion of treatment chemical through a bypass passage in each of the upper chemical injection valve systems.

8. The method as recited in claim 7, further comprising locating the flow-through passage and the bypass passage in a chemical injection valve system housing.

9. The method as recited in claim 4, further comprising compensating for differences in reservoir pressure or outlet pressure via the fluid metering valve.

10. The method as recited in claim 4, further comprising compensating for pressure loss via the fluid metering valve.

11. The method as recited in claim 4, further comprising providing at least one of the chemical injection valve systems with a rupture member to enable release of the treatment chemical in the event of a fluid metering valve operational failure.

12. A system for injecting chemicals in a well, comprising:

a well string deployed in a wellbore with a plurality of chemical injection valve systems, each chemical injection valve system being located in a unique well zone; and a single control line coupling the plurality of chemical injection valve systems to deliver a treatment chemical fluid to each unique well zone, the same single control line delivering the treatment chemical fluid to each unique well zone.

13. The system as recited in claim 12, wherein each chemical injection valve system comprises a flow-through passage and a fluid metering valve positioned in the flow-through passage to meter a desired amount of treatment chemical fluid into a surrounding well zone.

14. The system as recited in claim 13, wherein the fluid metering valves cooperate to compensate for differences in reservoir pressure between the well zones.

15. The system as recited in claim 14, wherein each fluid metering valve comprises a variable position choke.

16. The system as recited in claim 13, wherein each chemical injection valve system comprises at least one check valve positioned in the flow-through passage.

17. The system as recited in claim 13, wherein each chemical injection valve system that is located above a lowermost chemical injection valve system comprises a bypass passage to direct a remaining portion of the treatment chemical fluid down through the single control line to a next sequential chemical injection valve system.

18. The system as recited in claim 13, wherein a lowermost chemical injection valve system comprises a rupture member positioned between the pair of check valves and the fluid metering valve.

19. A method, comprising:

connecting a multi-point chemical injection system along a wellbore via a single control line routed downhole to multiple injection zones along the wellbore; and delivering a chemical along the wellbore to the multiple injection zones via the single control line run from a surface location.

20. The method as recited in claim 19, further comprising creating desired flow restrictions along the multi-point chemical injection system to enable injection of a desired amount of the chemical at each injection zone.

21. The method as recited in claim 19, wherein delivering comprises delivering a portion of the chemical at each injection zone and directing the remainder of the chemical through a bypass to a next sequential injection zone until a lowermost injection zone is reached.

22. The method as recited in claim 19, wherein connecting comprises connecting the single control line to a chemical injection mandrel at each injection zone.

23. A system, comprising:

a multi-point chemical injection system positioned in a wellbore, the multi-point chemical injection system comprising a plurality of injection valve systems positioned at a plurality of well zones to simultaneously deliver a treatment chemical to the plurality of well zones, the plurality of injection valve systems being supplied with treatment chemical delivered through a single control line which sequentially connects the plurality of injection valve systems.

24. The system as recited in claim 23, wherein each injection valve system comprises a fluid metering valve to meter the flow of treatment chemical to an adjacent well zone.

25. The system as recited in claim 24, wherein each injection valve system comprises a check valve to prevent backflow of reservoir fluid.

26. The system as recited in claim 25, wherein the fluid metering valves cooperate to compensate for differences in reservoir pressure.

* * * * *